US005171181A

United States Patent [19]

Freeman

[11] Patent Number: 5,171,181

[45] Date of Patent: Dec. 15, 1992

[54] SPINNER TOY

[76] Inventor: Stanley W. Freeman, 53299 Forest Lake Dr., P.O. Box 3757, Idyllwild, Calif. 92349

[21] Appl. No.: 831,904

[22] Filed: Feb. 6, 1992

[51] Int. Cl.[5] ..... A63H 1/06

[52] U.S. Cl. ..... 446/241

[58] Field of Search ..... 446/241, 236, 246, 245, 446/244, 243, 217, 218

[56] References Cited

U.S. PATENT DOCUMENTS 3,545,126 12/1970 Brown ..... 446/236

3,747,263 7/1973 Grossberg ..... 446/217

FOREIGN PATENT DOCUMENTS 530856 8/1954 Belgium ..... 446/241

*Primary Examiner*—Mickey Yu

*Attorney, Agent, or Firm*—William H. Pavitt, Jr.; Mario A. Martella; Daniel L. Dawes

[57] ABSTRACT

A spinner toy comprised of an elongated wire element looped back upon itself at its center and twisted to form a straight helical member, one end of which is the center loop and the other end of which is bent back upon itself and disposed in a plane passing through the member, with a first element slideably disposed on the straight member in abutment with the looped end. A spinner, formed by a pair of polyester film strips is disposed on the member angularly displaced apart from each other, each strip having first and second ends and being doubled back at a single intermediate orificed apex to bring its ends together with their orifices in register and secured together by an eyelet through which, and through the apex orifices, the member is passed, with a sleeve interposed and extending part way between the eyelet and the apex orifices, and a square plate between the eyelet and the sleeve. A second element is slideably disposed on the member between the orificed apexes and the second end of the helical member. When the first element is pushed rapidly against the eyelet along the helical member from the first end of the member toward its second end, the spinner rotates to assume a global configuration of decreasing axial length until it equals the length of the sleeve.

8 Claims, 2 Drawing Sheets

SPINNER TOY

FIELD OF THE INVENTION

This invention relates to toys and amusement devices in which an object is caused to rotate rapidly by forcing it to move up a helical element.

BACKGROUND OF THE INVENTION

Spinner type toys of the type falling within the field of the present invention have been devised since at least the early part of the 20th Century. Examples of patents disclosing different types of such toys are the Pierce U.S. Pat. No. 943,096; Furrow U.S. Pat. No. 1,133,719; Lloyd U.S. Pat. No. 1,167,507; Andreus U.S. Pat. No. 1,195,938; Vasquez U.S. Pat. No. 2,527,109; and Sarro U.S. Pat. No. 3,395,482.

While spinner toys of the type disclosed in such patents may provide different degrees of amusement, such toys may be of the type of which a person may quickly become tired so that, after a relatively brief period of usage, the toy may be set aside or discarded. A spinner toy, therefore, desirably should be able to be fabricated of very inexpensive materials and assembled with a minimum of labor, in order that the toy may be marketed at a very inexpensive price, i.e., a price which would not tend to inhibit purchasing the item with knowledge that its useful life will be short and that, at the end of which time, it may be discarded or set aside.

It should also be pointed out that because the actual spinning elements of the prior art toys are fabricated of a rigid material, such as a metal or plastic, when in full spinning motion, they pose a danger to any person's fingers, head or other part of the body which might be brought into contact with such element. This danger is particularly one to be avoided in the case of children.

Another problem with toys of this nature as disclosed in the patents listed above, lies in the fact that they may be bulky and not easily carried or stored. Such bulkiness also requires special packaging to prevent damage. Further, heretofore the spinning elements may also limit the number of the toys which can be packaged in a single box or other container.

In some cases, the rigidity of the spinning elements may contribute to distortion of the twisted element which may result in preventing the desired spinning effect.

SUMMARY OF THE INVENTION

The spinner of the present invention obviates a number of problems of the type which have arisen in the fabrication, marketing and operation of prior art spinning toys. This is because it employs no large rigid spinning parts. While its screw configuration may be created of a wire bent back upon itself and twisted, the helical member could also be molded of a rigid type of plastic. The actual spinning element is formed of a pair of special polyester or MYLAR strips orificed at their ends and looped back upon each other to be secured together in one embodiment, at their orificed ends by an eyelet through which the helical member may be passed, as well as through an orifice at the apex of each MYLAR loop. The two MYLAR loops may be disposed together, but with a 90 degree angular separation from each other about the axis of the helical member. In order to cause the MYLAR strips to rotate, a small square plate centrally creased and raised along one axis of the square, and centrally orificed to allow the helical member to be screwed therethrough, is disposed adjacent the eyelet securing the ends of the MYLAR strips. In addition, a washer is preferably disposed on top of the square plate, the washer also being of such size as to allow the threaded element to be screwed through it.

In addition, a plastic sleeve having an axial length approximating half of the axial length of the loop of the MYLAR loops, when in a stationary disposition, is disposed on the helical member against the washer and within the MYLAR loops.

The lower end of the helical member should terminate in some type of gripping means, such as a loop, between which and the eyelet holding the MYLAR loop ends, an orificed bead or sleeve which can be gripped by a person's fingers, is provided The upper end of the helical member is terminated by some type of closure, preferably planar in configuration with its plane coinciding with that of the gripping loop.

As so constructed, when the gripping loop is held in one hand and the intermediate bead or sleeve is held in the other nd pushed upwardly along the helical member, the MYLAR loops will be caused to spin about the element axis and to rise and assume a globular shape with decreasing axial length to the point where its axis length coincides with the length of the inner, sleeve. Because of the light weight of the MYLAR loops, once rapid rotation is initiated, further pushing the intermediate bead on the helical member upwardly may be stopped, and the MYLAR loops permitted to continue rapid spinning in a global pattern to give the appearance of floating until the rate of rotation begins to diminish, at which point, the MYLAR strips will drop back down the helical member to their original disposition and their original axial length.

Because the spinning element is constructed of thin MYLAR or polyester strips, it is incapable of slicing even a child's finger when rotated at its maximum r.p.m.

In second embodiment of the invention, the two MYLAR loops may be spaced axially from each other by the length of the inner sleeve. In this embodiment, only one MYLAR strip is mounted with its eyelet closed loop in the position previously described, and the other and second strip is mounted oppositely on the helical member, i.e. its eyelet is disposed oppositely and beyond the first loop and its closed loop end is within the first loop in the manner of a chain. In this embodiment, the rotation of the lower loop causes rotation of the second loop but with its axis displaced from the axis of the first loop. The second loop may likewise be provided with a second inner sleeve about the helical member.

It is also a feature of the present invention to provide a plastic sheath which is of sufficient size to be slipped over at least one end of the helical and of sufficient axial length to encompass the MYLAR strips in their at rest position. This sheath not only protects MYLAR strips from damage, but it enables each spinner to be packed side-by-side with numerous other spinners in a very small space.

All of these features of the present invention enable the spinner of the present invention to be manufactured most inexpensively and packed for marketing in a very small space. In addition, the plastic sheath enables the purchaser to protect the MYLAR strips when the spinner is not being activated.

DESCRIPTION OF THE PREFERRED EMBODIMENT

Figure 1:
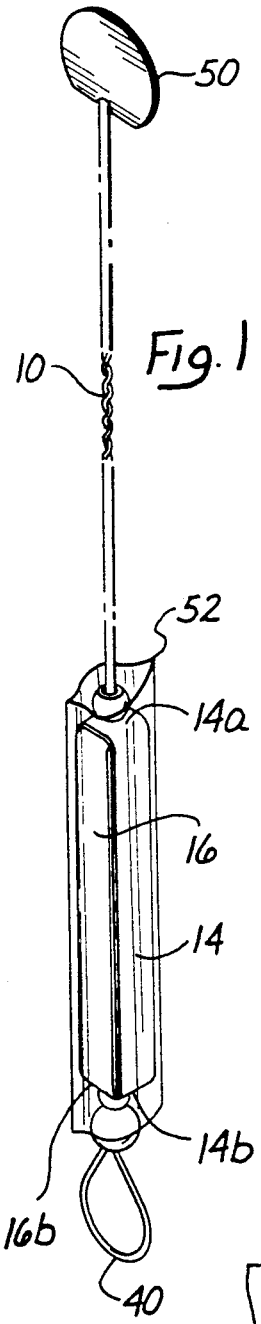
FIG. 1 is a perspective view of an embodiment of the invention in its packaged form.
Figure 2:
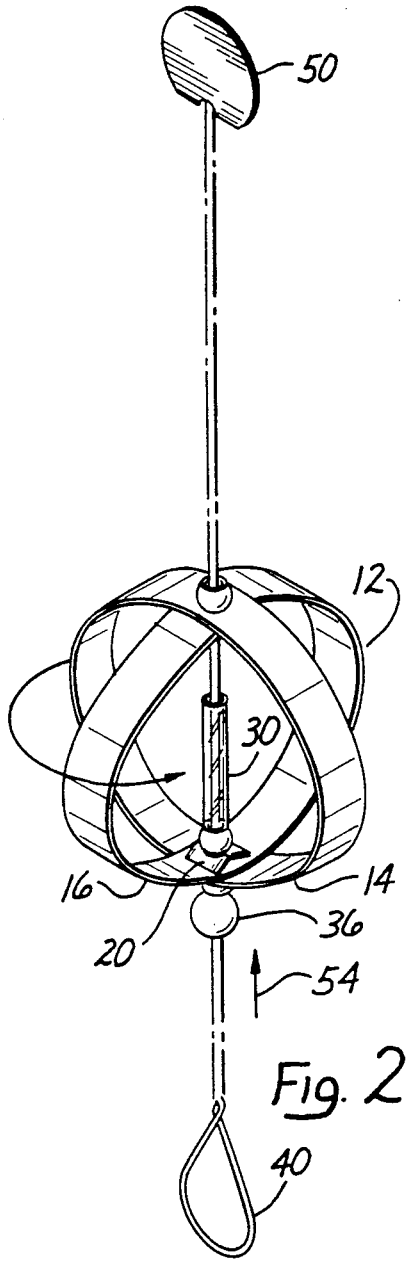
FIG. 2 is a perspective view of the toy with its spinner portion removed from the packaging and in the course of its initial upward movement.
Figure 3:
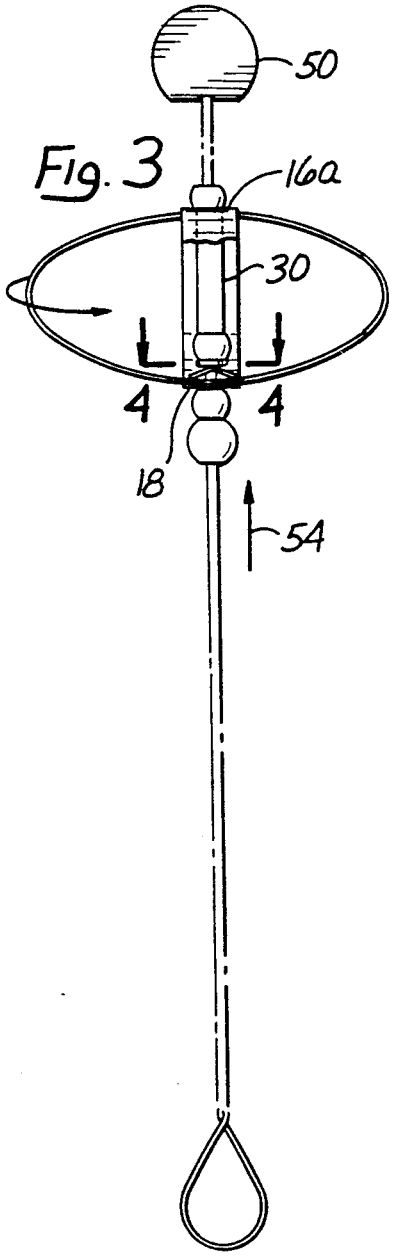
FIG. 3 is a side elevation of the toy as its spinning blades are reaching the zenith of the upward movement.
Figure 4:
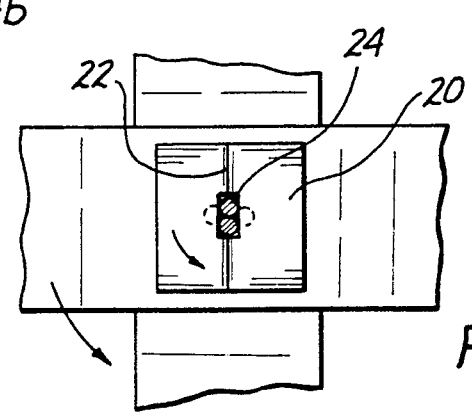
FIG. 4 is an enlarged section taken on the line 4—4 of FIG. 3 in the direction of the arrows.
Figure 5:
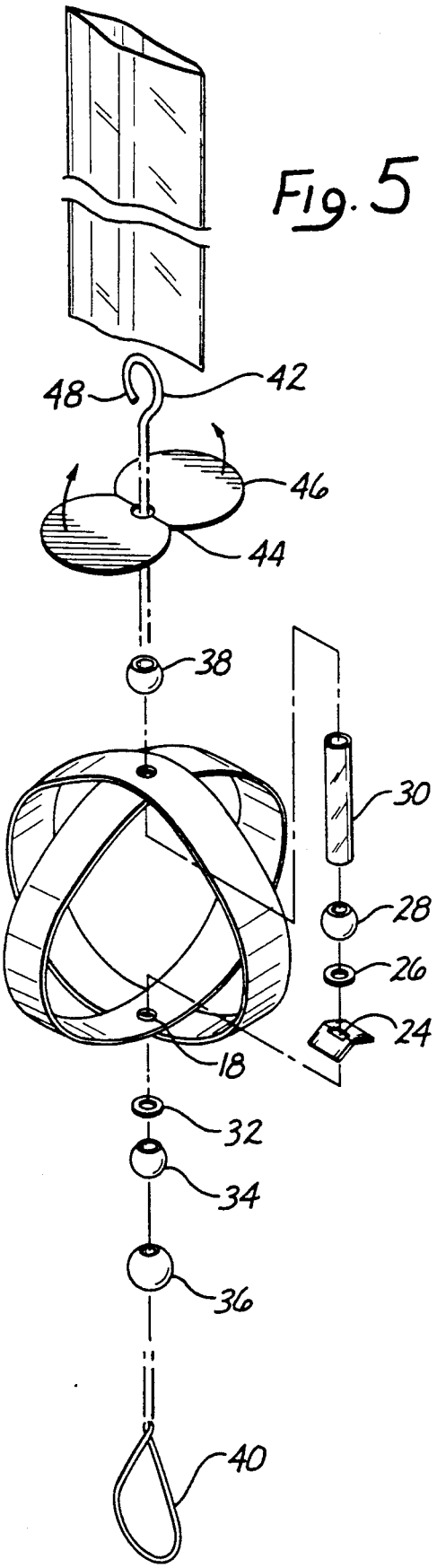
FIG. 5 is an exploded perspective view similar to FIG. 2.

Referring to FIGS. 1-5 inclusive, the toy of the present invention comprises a helical member 10 which carries a rotatable spinner 12 comprised of a pair of thin strips 14 and 16. The preferred strips 14, 16 are of a 0.002" irredescent foil micro groove structure of an embossed and metalized polyester film, covered with a 0.002" clear pressure sensitive polyester film. Alternatively, a simple MYLAR strip of the order of 0.004" thickness could be used. When the term "MYLAR" is used herein, it should be deemed to comprehend either the polyester film referred to or a metallic film of the type more popularly referred to as "MYLAR". Each of these strips 14, 16 is orificed at 14*a*, 16*a*, midway from its extremities 14*b*, 14*c* and 16*b* and 16*c*, respectively. Each of the extremities 14*b*, 14*c*, and 16*b* and 16*c* is orificed and all four extremities are held together by a common eyelet 18. The spinner 12 is mounted on the helical member 10 by passing the latter through the orifice 14*a*, 16*a* and the eyelet 18.

Within the thus mounted MYLAR strips is also mounted on the helical member 10 a base gripping element 20 which, desirably, may be square and angled upwardly towards its center 22 along one of its axes. It is also centrally orificed at 24 rectangularly so as to result in its being rotated helically when the member 10 is drawn or pushed through the opening 24.

Also mounted in sequence on the member 10 within the strips 14 and 16 is a washer 26, an orificed bead 28 and a plastic sleeve 30. The latter may be a cut length of a common straw which sleeve should not extend generally beyond half the axial length of the MYLAR loops formed by the strips 14, 16 when in the at rest position. Below the spinner in sequence from the eyelet 18 desirably may be provided a second washer 32, an orificed bead 34, and a larger orificed gripping bead 36. On the opposite side of the spinner 12, a third orificed bead 38 may be provided.

When the member 10 is initially formed, it may be a simple piece of 18 gauge wire which is bent back upon itself with a loop 40 and twisted, desirably with approximately 10½ twists per 2 inches of length. Such 18 gauge wire thus formed should provide sufficient rigidity for the element 10. The end 42 of the wire is initially straight to enable the member 10 to be passed through the various parts heretofore described as being mounted upon it. However, when mounting is completed, the end 42 is then passed through the orifice 44 of a foldable disk-like element 46, following which the end 42 may be bent into a hook shape 48 and the foldable disk element 46 is brought up to cover the hook in the manner shown in FIGS. 1 through 3 and 6 at 50. Desirably, in forming the hook 48, it should be bent in such a manner as to lie in substantially the same plane as the loop 40 at the other end of the member 10.

Because of the flexibility of the MYLAR strips, when packaged or the toy is not in use, they may be flattened and elongated as shown in FIG. 1. In this disposition, a protective plastic sheath 52 may be slipped over the loop 40 and over the strips 14 and 16 to protect such strips from being crushed or distorted during shipment, storage or other nonuse.

In use, the plastic sheath 52 is removed by slipping it back off the strips 16 and 14 and over the loop 40. The member 10 may be held substantially upright and the lower larger bead 36 is gripped with the fingers of one hand, while the loop 40 is held in the other. When the bead 36 is pushed quickly up the member 10 in the direction of the arrow 54 (FIGS. 2 and 3), it will be found that the MYLAR strips 16 and 14 will be caused to revolve rapidly about the member 10 at their axis. As a result of the centrifugal force exerted upon the strips 16, 14, they will assume a global appearance with a decreasing axis as they approach the end 42 capped by the folded disk 50. The decrease in the global axis, however, is limited to the length of the inner tube or sleeve 30. Because of the light weight of the MYLAR strips 14, 16, the global shape which they produce will appear to float toward the upper end 42 of the member 10. However, as soon as the revolution rate begins to diminish, the globe will appear to drop back down the member 10 and, as it does, the global axis will increase. When at rest, the strips will reassume the flattened configuration shown in FIG. 1.

Figure 6:
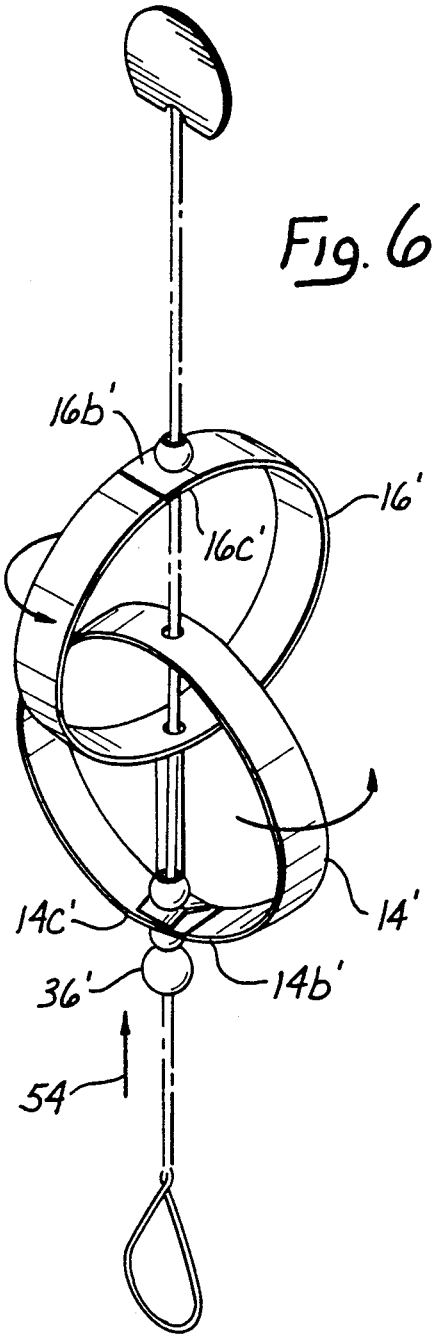
FIG. 6 is a perspective view of a modified embodiment of the invention.

FIG. 6 illustrates a modified embodiment of the invention in which the strips 14' and 16' are axially displaced and interlocked in the manner of a chain. The ends of the two strips are not held together by a common eyelet 18 as in the embodiment of FIGS. 1-5, but only ends 14*b*', 14*c*' of the strip 14, will be held by an eyelet (not shown) similar to eyelet 18 shown in FIG. 5. The strip 16' is reversed so that its two ends 16*b*' and 16*c*' are at the upper end of the loop and are also secured together by an eyelet (not shown). Each thus formed loop is provided with its own sleeve 30', 30".

In this modified embodiment, when the bead 36' is forced upwardly in the direction of the arrow 54', the two strips will produce a double global effect.

It will be found that spinner toys constructed in accordance with the present invention are of great fascination to those manipulating them. They may be made most inexpensively and easily packaged and protected from damage during periods of nonuse, and their spinning elements present no danger to the fingers or hands of even small children.

I claim:

1. A toy comprising:

an elongated wire element looped back upon itself at its center and twisted together to form a straight helical member of a predetermined finite length, said member having first and second ends, the twisting being substantially regular and in the order of 10½ twists per two inches of length of the member, the first end of the member being the looped back end and the second end of the member being bent back upon itself and disposed in a plane passing through said member;

a first element slideably disposed on the straight member in abutment with the loop of the first end, said first element being of sufficient size to be grippable by the fingers of a person;

a spinner, said spinner being formed by a pair of thin polyester film strips, each having first and second orificed ends and being doubled back at a single intermediate orificed apex to bring its ends together with the orifices in the ends in register and secured together by an eyelet, and the two strips being disposed on the member which is passed through the eyelet and the apex orifices of both strips, the strips being angularly spaced apart from each other;

a sleeve slideably disposed on said member between the eyelet and the intermediate apexes and extending part way therebetween; and a small centrally and rectangularly orificed square plate helically disposed on said member between the eyelet and the sleeve;

a second element slideably disposed on the helical member between the intermediate apexes and the second end of the helical member;

whereby, when the first element is pushed rapidly against the eyelet up along the helical member from its first end towards its second end, the spinner is caused rapidly to rotate and to assume a global configuration of decreasing axial length until it equals the length of the sleeve.

2. The toy as described in claim 1 wherein the second end of the member is provided with a covering disk-like element, said element lying in the same plane as that of the loop of the first end of the member.

3. The toy as described in claim 1 wherein a flexible plastic sheath is provided to be slipped over at least one end of the member and over the spinner to protect the spinner from damage during packing, carrying and other periods of nonuse.

4. The toy as described in claim 1 wherein a third and bead-like element is slideably disposed on the member between the square plate and the adjacent end of the sleeve.

5. The toy as described in claim 1 wherein the slideable plate-like member is slightly arched centrally along one of its axis.

6. A toy comprising:

an elongated helical member having first and second ends, a spinner disposed on said member, said spinner being formed of at least one thin polyester film strip looped back to bring its ends together, said ends being orificed and secured together by an eyelet, and said strip having an orifice intermediate its ends, said member being passed through said eyelet and said intermediate orifice, said eyelet being in proximity to the first end of the member;

a sleeve slideably disposed on said member between the eyelet and said intermediate orifice and extending part way therebetween;

a small centrally and rectangularly orificed square plate disposed on said member between the eyelet and the sleeve;

a first gripping element slideably disposed on the member adjacent its first end between the latter and the eyelet;

a second element slideably disposed on the member between the intermediate orifice and the second end of the member;

whereby, when the first gripping element is pushed against the eyelet rapidly up along the helical member from its first end toward its second end, the spinner is caused rapidly to rotate and to assume a global configuration of decreasing axial length until it equals the length of the sleeve.

7. The toy as described in claim 6 wherein the spinner is formed of at least two thin metallic strips with the ends of both strips being secured together by a single eyelet.

8. The toy as described in claim 7 wherein the spinner is formed of a first polyester film strip and a second looped back thin polyester film strip axially displaced and looped interlocking with the first strip, but oppositely mounted on the member so that its eyelet is closer to the second end of the member than to the first end of the member.

* * * * *